United States Patent [19]

Gross et al.

[11] 4,074,655

[45] Feb. 21, 1978

[54] EDGE COATING APPLICATOR NOZZLE

[75] Inventors: William G. Gross, York; Henry A. Long, Jr., Columbia; John R. Yamshak, Lancaster, all of Pa.

[73] Assignee: Armstrong Cork Company, Lancaster, Pa.

[21] Appl. No.: 733,102

[22] Filed: Oct. 18, 1976

[51] Int. Cl.[2] ..... B05C 3/02

[52] U.S. Cl. ..... 118/410; 118/DIG. 9; 239/601

[58] Field of Search ..... 239/598, 599, 601; 401/9; 118/410, 415, 411, 412, 408, DIG. 9; 222/575

[56] References Cited

U.S. PATENT DOCUMENTS

| | | | |
|---|---|---|---|
| 683,301 | 9/1901 | Leahy | 239/601 X |
| 2,065,298 | 12/1936 | Abbott | 118/415 X |
| 2,709,268 | 5/1955 | Kamborian | 118/410 X |
| 3,334,792 | 8/1967 | Vries et al. | 118/410 UX |
| 3,413,143 | 11/1968 | Cameron et al. | 118/410 X |

*Primary Examiner*—John J. Love

[57] ABSTRACT

An applicator nozzle adapted to apply a liquid coating to the shaped edge portions of work pieces. The nozzle is particularly adapted for applying a finish coat of paint to the beveled and adjacent nonparallel planar surfaces of the edges of fiberboard. The nozzle comprises a body member having a nose portion shaped to conform to the main configuration of the board edge to be coated. The front face of the nose portion has an open-end reservoir and a slot extending upwardly therefrom. A passageway extends from the reservoir through the length of the nozzle. Paint is fed through the passageway to the reservoir. During the application of paint to the edge portion of a board being conveyed past the nozzle, the beveled edge passes through a stream of paint issuing from the reservoir and partially seals it off, thus causing the paint in the reservoir to pressurize and be forced into any voids in the board's edge surface. The paint is simultaneously forced upwardly through the slot extending from the reservoir and is applied to the lower surface of the tongue and a small vertical edge portion of the board which extends from the beveled edge to the tongue's lower surface.

8 Claims, 4 Drawing Figures

EDGE COATING APPLICATOR NOZZLE

BACKGROUND OF THE INVENTION

1. Field of the Invention

This invention relates to a nozzle for applying a liquid coating to the edge portions of work pieces. More particularly, the invention relates to an applicator nozzle for coating raw beveled and tenoned edge portions of previously surface coated, decorated panel material such as fiberboard ceiling tiles and panels.

2. Description of the Prior Art

In the formation of decorative fibrous panel board and acoustical ceiling tiles in the past, a prime coat and an intermediate coat of paint were applied to one surface of the material in the course of its manufacture. The material was then cut into the desired lengths and widths. The boards were then tenoned, and bevels formed thereon were ironed and coated with a prime coat of paint. The boards and bevels thereon then received a finishing coat of paint in a separate operation.

It has been recognized in the past that it would be desirable to eliminate the separate operation required for applying the finish coat and be able to obtain a finish-coated work piece directly from the tenoner. However, coating of the beveled edges formed in the tenoning operation has presented a problem in the past. Since fiberboard is porous, the cross-cut surfaces at the beveled portions have loose fibers, fiber ends, and voids which, when painted, have a rough texture and a color which contrasts with the coated face of the work piece. It has also been desirable, due to the dimensional instability of the product, to be able to not only coat the angled bevel edge portion of the work piece, but to also coat part of the remaining edge detail consisting of both a vertical and a horizontal surface since this would eliminate dark lines produced by exposed, unpainted board as the tiles grow and shrink while adjusting to humidity changes after installation. Former methods of coating the edge portions resulted in portions of the edges being skipped and receiving little or no paint. This resulted because the bevels must be coated consistently and accurately at line speeds up to 200 feet per minute, and because the boards may shift slightly as they travel through the tenoner or the board may be warped slightly. Another problem involved in attempting to obtain a finish-coated product directly from the tenoner arises from the fact that since the face of the board would necessarily be finished prior to the bevel coating, complete coverage of the bevel without any noticeable bevel paint on the face is required. Application of coatings of the desired thickness on the edge portions of the work pieces have also been a problem in the past.

Typical of the apparatus used in the past to coat beveled edges of panel boards are those disclosed in U.S. Pat. Nos. 2,165,210 and 2,811,133. In the case of U.S. Pat. No. 2,165,210, a rotatable disk having a circular plane face is inclined at an angle to the horizontal and dips into a supply of coating composition as it rotates, thus transferring a film of the coating composition to a beveled edge surface of a work piece. In U.S. Pat. No. 2,811,133, a similar arrangement is used for picking up the coating material and transferring it to another surface; however, in this case, the coating composition is transferred to a smooth transfer roll which in turn transfers the coating to the beveled edge of the work piece.

U.S. Pat. No. 3,015,301 discloses an apparatus for painting grooves or bevels in the surface of a fiber wall board unit and comprises a vertical paint transfer wheel having a beveled paint carrying and applying peripheral face. A paint spray gun mounted adjacent thereto supplies a uniform coat of paint directly to the peripheral face of the transfer wheel for application to the grooved or beveled portion of the work piece.

U.S. Pat. No. 1,980,552 relates to a paint striping nozzle which is adapted to simultaneously stripe the edge and adjacent side portions of an article. The body portion of the nozzle includes an upper curved nib which protrudes beyond the outlet of a paint discharge duct and extends slightly into the path of the paint which is discharged therethrough. This nib is adapted to engage one surface of an article and hold the outlet of the duct in a predetermined spaced relation from the surface of the article upon which paint is directly sprayed. The nozzle also has a concave nib on the lower portion thereof which extends beyond the extremity of the upper nib and forms a seat for receiving an edge portion of the article or work. This nib has a well which accumulates some of the paint that is discharged from the outlet of the duct and holds it in engagement with the edge portions of the work. In operation, the duct 12 sprays paint directly upon one side surface of the article while the other side surface and edge portion of the article receive paint from the well of the lower nib.

U.S. Pat. No. 3,967,581 relates to an apparatus for applying and smoothing a sealing material under pressure to the edge of particle board. The applicator utilizes a rotary valve means, which may be configured to match the shape of the edge to be coated. The valve has an outlet orifice whose length matches the width of the edge to be coated and may be configured in accordance with the shape thereof. Work piece guides prevent escape of pressurized coating material from the edge portion being coated, and a surface recessed in the amount of the intended thickness of the edge coat is provided adjacent the coating application point and displaced therefrom in the direction of travel of a work piece through the apparatus to limit the amount of material extruded and also to smooth the coating.

None of the prior art disclosures provide a solution to the problems aforementioned.

The coating applicator nozzle of this invention provides a device which will enable finish-coated, beveled edge ceiling boards and panels to be obtained directly from the tenoning operating, thus eliminating a step in the production operation and resulting in a substantial savings of labor, material-handling time, and coating material.

SUMMARY OF THE INVENTION

According to the present invention, there is provided an applicator nozzle for applying a liquid coating to the shaped edge portions of work pieces. More particularly, the applicator nozzle is adapted for simultaneously applying a finish coating to adjacent surfaces of the edge portions of beveled and tenoned edges of fiberboard in a manner which is easy and rapid without causing any paint to be applied to surfaces which are not desired to be painted or which have been previously painted with a finish coat.

The applicator nozzle of the present invention comprises a main body portion having a longitudinally extending material discharge passageway formed therein. A nose portion formed on the main body portion is shaped to conform to the configuration of a major portion of the surfaces to be coated and has a front face with a coating material reservoir extending inwardly therefrom in communication with the material discharge passageway in the main body portion. A material outlet groove extends from the reservoir to a slanted top surface portion of the nose of the nozzle. In use, the nozzle is positioned so that the beveled edge portion of the board being conveyed past the nozzle will pass through a stream of paint issuing from the reservoir and partially seal it off, thus causing the paint in the reservoir to pressurize and be forced upwardly out through the slot or groove onto the flat top surface of the nose portion of the applicator with the result that, through this arrangement, not only is the bevel coated, but the small vertical edge adjacent the bevel and at least a portion of the lower surface of the horizontally extending tongue of the board will also be coated. The shape of the nose portion of the nozzle enables it to be mounted properly in position on a high-speed production line and further enables the proper application of a finish coat of paint to be applied and forced into the pores of the beveled and adjacent edge portions of the board without causing any paint to be applied to surfaces where it is not desired that the paint be applied.

The nozzle is made of a rigid material, such as metal or plastic, and has a flat bottom surface, side surfaces which are perpendicular to the bottom surface, and a flat top surface portion. The top surface of the nose portion of the nozzle extends downwardly at an angle from the flat top surface portion of the main body to the face of the nose of the nozzle. The front face of the nose portion of the nozzle has a multiplane surface and extends rearwardly at an angle from the side surface. The top surface of the nose portion is trapezoidal in shape, and the multiplane front face surface of the nose portion includes a trapezoidal-shaped portion, with the coating material reservoir extending inwardly therefrom in a plane perpendicular to the plane of the upper portion of the front face of the nose portion. Adjacent the reservoir-containing portion of the face of the nose of the nozzle there is provided a trapezoidal-shaped, slightly recessed portion of the face. This recessed portion is provided to avoid scraping off of the applied coating, which might occur because of warped boards or shifting of boards as they move through the tenoner. The lower portion of the face of the nose of the nozzle comprises a further recessed rectangularly-shaped portion which, when the nozzle is in use, allows excess paint to follow this contour and be conducted away from the beveled edge and the finished face portion of the board. Thus, the improved nozzle of this invention makes it possible to provide a finish coat of paint on beveled edge ceiling tile or panel boards in a two-step process instead of the three-step process required in the past. Further, the nozzle of the present invention allows the coating to be carried out consistently and accurately at production line speeds up to about 200 feet per minute while still assuring that the small voids existing in the fiberboard after cutting will be satisfactorily filled and coated without any noticeable bevel paint on the finished face portion of the tile. Still further, through the use of the nozzle of this invention, paint is not only applied to the beveled portion of the board, but to the adjacent vertical and horizontal portions of the edge of the tile as well. This eliminates dark lines produced by exposed, unpainted board as the tile grow and shrink while adjusting to humidity changes after installation.

The nozzle of this invention also eliminates the problem of skipped portions on the bevel of the board, or places where the paint was inadvertently not applied due to shifting of the boards as they moved through the tenoner, or through slight warping of the boards.

BRIEF DESCRIPTION OF THE DRAWING

In the accompanying drawing, which forms part of this specification.

DESCRIPTION OF THE PREFERRED EMBODIMENT

Figure 1:
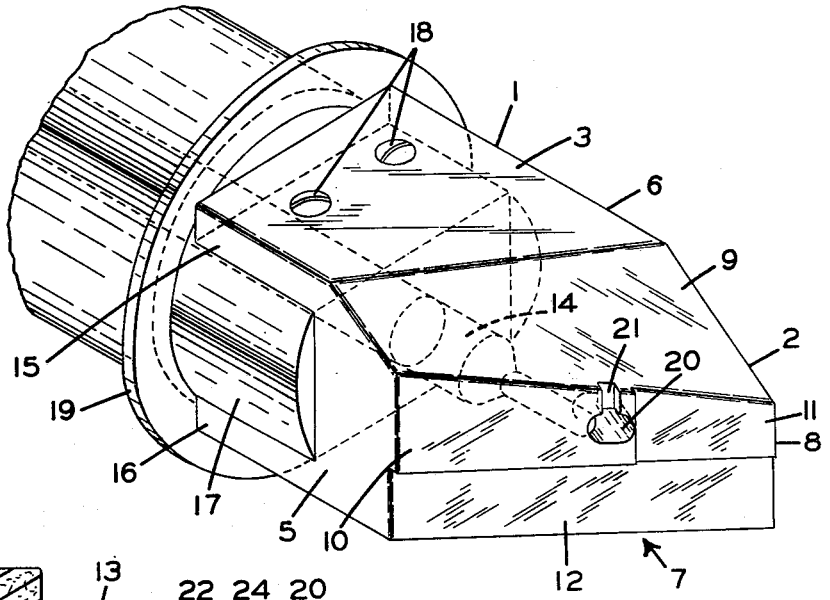
FIG. 1 is an isometric view of the nozzle of this invention mounted on a support structure.
Figure 2:
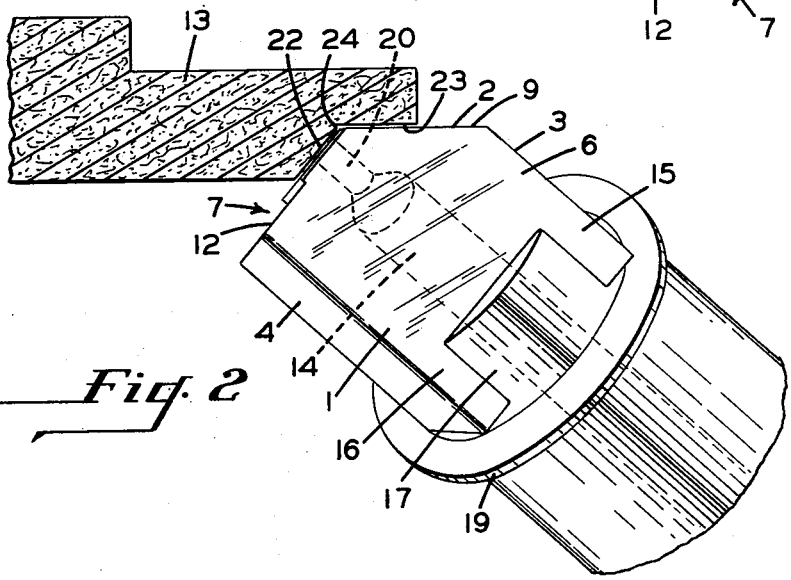
FIG. 2 is a view showing the nozzle of this invention mounted on a support structure and in position to apply a coating of paint to the beveled and adjacent edge portions of a work piece of which a sectional portion only is shown.
Figure 3:
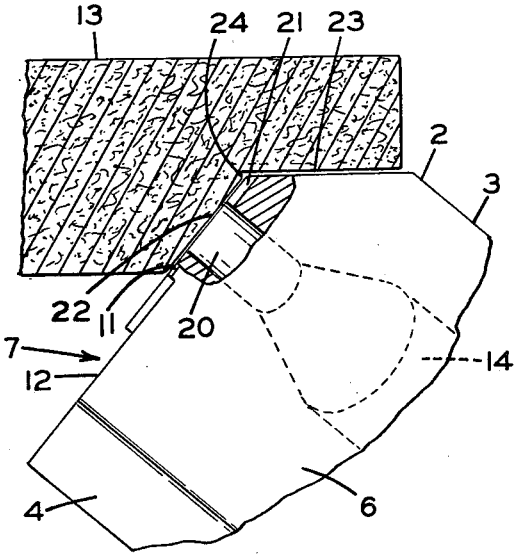
FIG. 3 is an enlarged portion of the nose portion of the nozzle and sectional edge detail of the board, with a portion of the nose of the nozzle broken away to show the structure of the nozzle which enables the coating material issuing therefrom to be applied to not only the beveled portion of the board, but the adjacent surfaces to be coated as well.

Referring to the drawings, there is shown in FIG. 1 the preferred embodiment of the applicator structure of this invention. The applicator nozzle is preferably made of a rigid material such as metal or plastic and comprises a main body portion 1 with a nose portion 2. As shown in FIGS. 1, 2, and 3 of the drawings, the nose portion 2 of the applicator nozzle body 1 is shaped to substantially conform to the configuration of the edge portions of the work piece to be coated when the applicator nozzle is in its normal position with respect to the work pieces being conveyed past the nozzle on a production line. As shown in FIGS. 1 and 2 of the drawings, the body member 1 has a flat top surface portion 3, a flat bottom surface 4, and side surfaces 5 and 6 which are perpendicular to top and bottom surfaces 3 and 4. The nose portion 2 of the nozzle has a front face surface 7 which extends rearwardly at an angle from the front edge 8 of the side surface 6. The top surface 9 of the nose portion 2 extends downwardly at an angle from the flat top surface portion 3 of the body 1 to the front face surface 7 of the nose portion 2 of the nozzle. The front face surface 7 of the nose portion of the nozzle is a multiplane surface consisting of an upper portion 10 and an adjacent, slightly recessed portion 11. A further recessed portion 12 is provided on the lower portion of the front face surface 7 of the nozzle. The top surface 9 of the nose portion, and portions 10 and 11 of the front face surface 7 of the nozzle are trapezoidal in shape. The shapes of surfaces 9, 10, and 11 result from the shaping of the nose portion 2 of the body member 1 to fit the configuration of the edge portions of the work piece to be coated when the nozzle is in the desired position when mounted on the production line. Similarly, the slope of the top surface 9 of the nose portion 2 and the rearward angle of the front face surface 7 of the nose portion 2 are necessary to enable positioning of the nozzle with respect to the edge portion of a work piece 13, as shown in FIGS. 2 and 3 of the drawings.

The body portion 1 of the nozzle contains a longitudinal material discharge passageway 14 therein. Flat, rearwardly extending top and bottom portions 15 and 16 of the body 1 of the nozzle are provided for mounting the nozzle on a support structure, such as shown at 17, for example, to place the material discharge passageway 14 in communication with a material supply source (not shown). The nozzle may be mounted on the support structure 17 by attaching means such as screws 18 which pass through appropriate openings in the members 15 and 16 into the support structure 17. Conventional means such as a drip ring 19 may be provided on support structure 17 to keep paint from running down along the surface thereof.

A coating material reservoir 20 is provided in the upper portion 10 of the front face surface of the nose portion of the nozzle and extends inwardly therefrom in a plane perpendicular to the plane of the face portion 10 of the front surface 7 of the nose portion and is in communication with the material discharge passageway 14. A material discharge outlet 21 extends from the coating material reservoir 20 to the slanted top surface 9 of the nose portion 2.

The applicator nozzle of the present invention is particularly adapted for the coating of the beveled edge and adjacent non-parallel planar surfaces of fiberboard ceiling tile.

Ceiling tile is normally made in square pieces, two of the edges thereof each having a beveled portion and a tongue portion, while the remaining two edges each have a grooved portion with a bevel on the lower edge portion of the tile. The applicator nozzle of this invention may be modified for use on this beveled portion of the tile by merely eliminating the material discharge passageway 21 which leads from the coating material reservoir 20 to the top surface of the nose portion. This modification would provide for the proper seal across the reservoir and help minimize wasted paint.

In use, the applicator nozzle of this invention would be positioned as shown in FIG. 2 of the drawings with respect to the work piece 13 which in this view may be considered as being moved by known conveying means in a known manner toward the viewer past the applicator nozzle. The upper surface portion 10 of the front face 7 of the nose 2 of the nozzle, and the top surface 99 thereof are preferably positioned from about 0.002 inch to 0.045 inch (0.0508 mm to 1.1430 mm) away from the beveled surface 22 of the work piece 13 and the lower surface 23 of the tongue thereon respectively. With the nozzle so positioned, as the work piece 13 is moved past the nozzle, the bevel passes through an approximately 3/32 inch (2.3799 mm) stream of paint issuing from the nozzle and partially seals off the reservoir, which causes the paint being pumped into the reservoir from a supply source (not shown) to pressurize slightly. This pressure (about 4–6 psi) forces the paint, which preferably has a viscosity of about 30–40 centipoise, out of the reservoir 20, causing it to be applied to the front face surface 7 of the nose portion onto the beveled portion 22 of the work piece 13. The paint is also forced upwardly through the material discharge opening 21 onto the vertical edge 24 of the work piece 13, and is applied to the bottom surface 23 of the tongue thereof by means of the flat top surface 9 of the nose portion 2 of the nozzle, the paint also being forced into any voids in the board surface. The result is a well-coated edge configuration.

Figure 4:
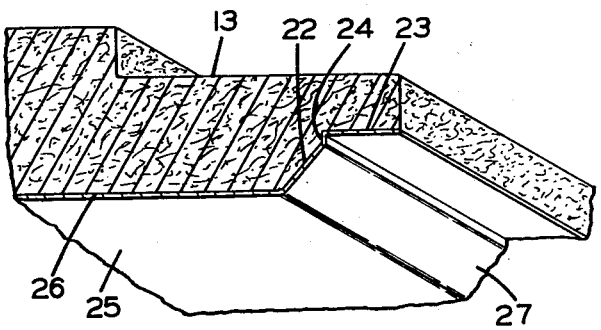
FIG. 4 is a sectional perspective view of the edge portion detail of the board and showing the coating applied to the beveled and adjacent portions thereof.

In FIG. 4 of the drawings there is shown the finish-coated work piece 13 having a previously-applied coating 25 on the face 26 thereof and coating material 27 applied to edge portions 22, 23, and 24 by the applicator nozzle of this invention.

Upon completion of coating the bevels and adjacent edge surfaces, the paint is normally dried with heat guns or the like. At this point, the tile can be packaged as a finished product, rather than moved to another paint line for an additional operation, as was necessary prior to the development of the applicator nozzle of this invention.

What is claimed is:

1. A one-piece applicator nozzle comprising:

(a) a body member having a flat bottom surface, side surfaces perpendicular to said bottom surface, and a flat top surface portion, said body further having a material discharge passageway formed therein and extending longitudinally through a portion thereof;

(b) a nose portion on said body member, said nose portion having a front face with a coating material reservoir extending inwardly therefrom in communication with said material discharge passageway, and a top surface extending upwardly at an angle from the face of said nose portion to the top surface portion of said body member, said front face of said nose portion further having a material discharge outlet formed therein and extending downwardly from the top surface of the nose portion in communication with said reservoir; and (c) means integral with said body member for placing said material discharge passageway in communication with a material supply source.

2. The applicator nozzle of claim 1 wherein the body member is formed of a rigid material and the nose portion thereof is shaped to conform to the configuration of a major portion of the surfaces to be coated.

3. The applicator nozzle of claim 2 wherein the body member is made of plastic material.

4. The applicator nozzle of claim 2 wherein the body member is made of metal.

5. The applicator nozzle of claim 1 wherein the front face of said nose portion is a multiplane surface and extends rearwardly at an angle from a side surface.

6. The applicator nozzle of claim 5 wherein the top surface of the nose portion is trapezoidal in shape and wherein the multiplane front face surface of the nose portion includes an upper portion comprising a trapezoidal-shaped portion with the coating material reservoir extending inwardly therefrom and an adjacent trapezoidal-shaped recessed portion and the lower portion of the face comprises a further recessed rectangularly-shaped portion.

7. The applicator nozzle of claim 1 wherein the means for placing said material discharge passageway in communication with a material supply source comprises flat, rearwardly extending top and bottom portions of said body member and having openings therein adapted to receive means for attaching said nozzle to a support structure.

8. The applicator nozzle of claim 6 wherein the material reservoir extends inwardly in a plane perpendicular to the plane of the upper portion of the front face of the nose portion.

* * * * *